United States Patent [19]

Narayan et al.

[11] Patent Number: 4,551,889

[45] Date of Patent: Nov. 12, 1985

[54] LOW FRICTION SELF-LOCKING ADJUST TONGUE

[75] Inventors: Surendra D. Narayan; Rudy V. Thomas, both of Sterling Heights, Mich.

[73] Assignee: Allied Corporation

[21] Appl. No.: 673,819

[22] Filed: Nov. 21, 1984

[51] Int. Cl.[4] ..... A44B 11/06

[52] U.S. Cl. ..... 24/196; 24/171

[58] Field of Search ..... 24/196, 171, 168, 197

[56] References Cited

U.S. PATENT DOCUMENTS

| | | | |
|---|---|---|---|
| 252,092 | 1/1882 | Flück | 24/171 |
| 1,292,298 | 1/1919 | Fritsche | 24/196 |
| 1,363,318 | 12/1920 | Heberling | 24/171 |
| 3,237,263 | 3/1966 | Holmberg | 24/196 |
| 3,974,546 | 8/1976 | Walker | 24/196 |
| 3,975,800 | 8/1976 | Färlind | 24/196 |
| 4,069,554 | 1/1978 | Minolla et al. | 24/171 |
| 4,184,234 | 1/1980 | Anthony et al. | 24/196 |
| 4,364,584 | 12/1982 | Rogers, Jr. et al. | 24/196 |
| 4,386,452 | 6/1983 | Stephenson | 24/196 |
| 4,480,854 | 11/1984 | Doty | 24/171 |

*Primary Examiner*—William E. Lyddane
*Assistant Examiner*—Peter A. Aschenbrenner
*Attorney, Agent, or Firm*—James R. Ignatowski; Russel C. Wells

[57] ABSTRACT

A low friction self-locking adjust tongue having a pair of depressed lands provided in the tongue plate either side of the web aperture to form a lock bar well. Cut-outs provided in the tongue plate's upstanding flanges form in conjunction with said depressed lands a bi-level lock bar slot extending rearwardly and upwardly from the lock-bar well to above the plane of the tongue plate. In the unlatched position of the tongue plate, the lock bar rests in the lock bar well permitting the seat belt webbing to pass thereover with negligable friction. In the locked position, the lock bar is displaced towards the rear of the bi-level lock bar slot which raises the lock bar above the plane of the tongue plate. In this position, the friction between the lock bar and the seat belt webbing is sufficient to lock the seat belt webbing in the tongue plate after it is snuggly adjusted about the occupants pelvic region.

22 Claims, 6 Drawing Figures

Fig-4
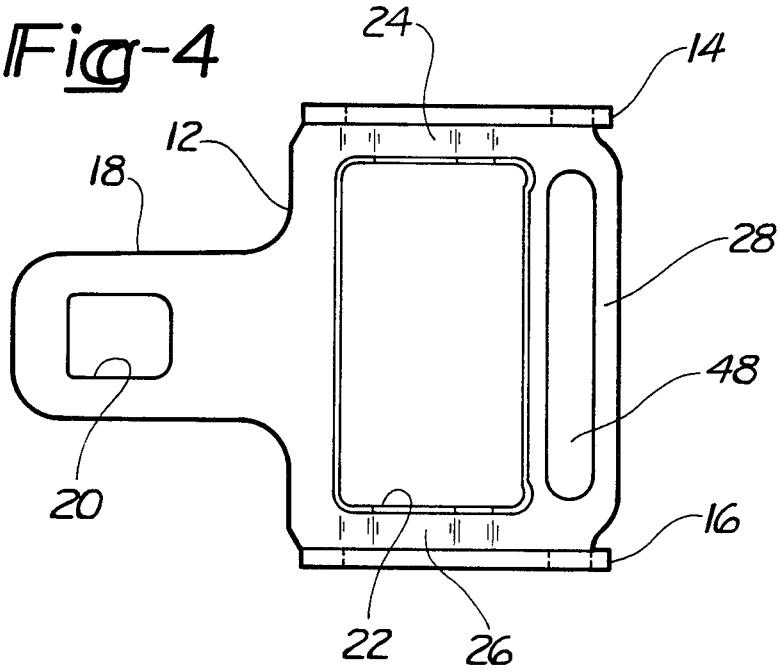
Fig-5
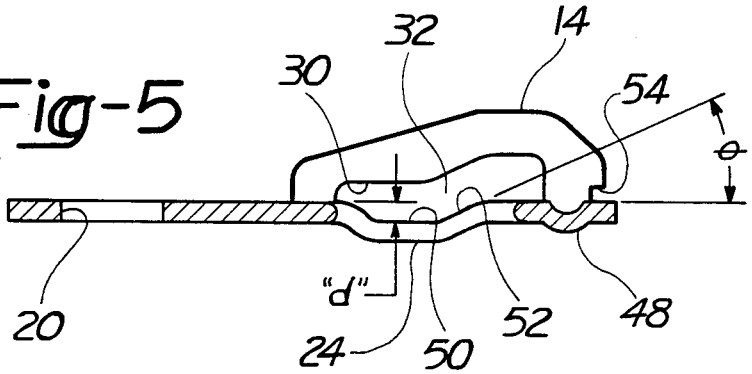
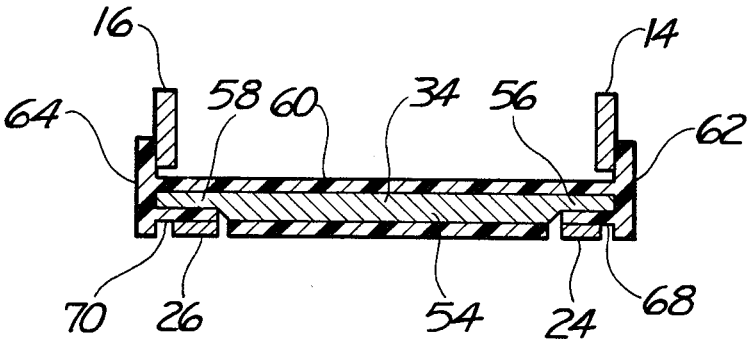
Fig-6

LOW FRICTION SELF-LOCKING ADJUST TONGUE

BACKGROUND OF THE INVENTION

1. Field of the Invention

The invention is related to automative safety restraint systems and in particular to a low friction self-locking adjust tongue assembly for a three point seat belt system.

2. Prior Art

In vehicles equipped with active seat belt systems, self-locking adjust tongues are commonly used to snug the lap portion of the seat belt about the occupant's pelvic region. Center seats are frequently equipped with static lap belts, which after buckling, require the occupant to pull the loose end of the webbing exiting the adjust tongue to provide a snug fit about the pelvic region. The adjust tongue must be capable of preventing the loose end of the webbing from slipping in order to provide the occupant protection under crash conditions.

Government regulations require that lock-up occur when specific angles between the ingressing webbing and the base plate of the tongue are experienced, (e.g. at a minimum angle of 30°). Conventional adjust tongues, such as disclosed by Stephenson in U.S. Pat. No. 4,386,452, have a lock bar slidable in slots provided in longitudinal upstanding flanges, with the webbing wrapped around the lock bar.

Continuous loop seat belt systems having retractors provided with tension eliminators are commonly used in the front outboard positions. Self-locking adjust tongues are again an essential part of such systems. The adjust tongue must be capable of sliding on the webbing to provide proper fit to the occupant but must lock up, disallowing slippage over the lock bar, under crash conditions and prevent any slack in the shoulder portion of the seat belt from being transferred to the lap portion.

Although the current self-locking adjust tongues permit the occupant to slide the self-locking adjust tongues for proper fit, the friction between the adjust tongue and the seat belt webbing is sufficient to maintain the adjust tongue in place after the tongue has been released from the buckle. Upon release of the adjust tongue, the seat belt retractor will begin to wind up the loose portion of the seat belt webbing but will stop when the adjust tongue reaches the retractor or when the retractor is located near the floor, it will stop when the adjust tongue engages web guide normally mounted to the vehicle's pillar at shoulder height. As a result, the seat belt webbing is not fully retracted into the retractor and dangles loose. Often this unretracted portion of the webbing gets caught in the door well when the vehicle's door is closed making it impossible to buckle up the seat belt without having to re-open the door to free the seat belt webbing. Further, this often results in the seat belt webbing becoming soiled and unsightly.

The invention is a self-locking adjust tongue in which the friction between the tongue and the seat belt webbing in an unbuckled state, has been reduced, such that the engagement of the adjust tongue with the retractor or web guide will not prevent the retractor from fully retracting the seat belt webbing eliminating the problem discussed above.

SUMMARY OF THE INVENTION

The invention is a low friction self-locking adjust tongue for a safety restraint system. The self-locking adjust tongue is of the type having a generally planar tongue plate having a pair of longitudinal upstanding flanges and a lock bar slidably received in a pair of lock-bar slots formed in the upstanding flanges. The lock bar traversely spans a web aperature formed in the tongue plate between the flanges and passes through a loop of seat belt webbing inserted through the web aperture. The low friction self-locking adjust tongue is characterized by a pair of depressed lock bar guide lands provided in the tongue plate on opposite sides of the web aperture to form a lock bar well intermediate the extermities of the web aperture below the plane of the tongue plate. The lock bar well has at least one sloping surface connecting the bottom of the lock bar well with the plane of the tongue plate. Cutouts provided in each of the flanges form, in cooperation with the guide lands, a bi-level lock bar slot for guiding the lock bar from a low friction position in said lock bar well to a locking position above the plane of said tongue plate in response to the rearward displacement of the lock bar.

The advantage of the low friction self-locking adjust tongue is that in the unlocked state there is negligible friction between the lock bar and the seat belt webbing permitting the seat belt retractor to fully retract the seat belt webbing. This and other advantages of the low friction self-locking adjust tongue will become more apparent from reading the detailed description of the invention in conjunction with the appended figures.

BRIEF DESCRIPTION OF THE FIGURES

FIG. 4 is a top view of the tongue plate.

FIG. 5 is a cross-sectional side view of the tongue plate.

FIG. 6 is a cross-sectional view of the lock bar and plastic sleeve taken along the sectional line 6—6 in FIG. 3.

DETAILED DESCRIPTION OF THE INVENTION

Figure 1:
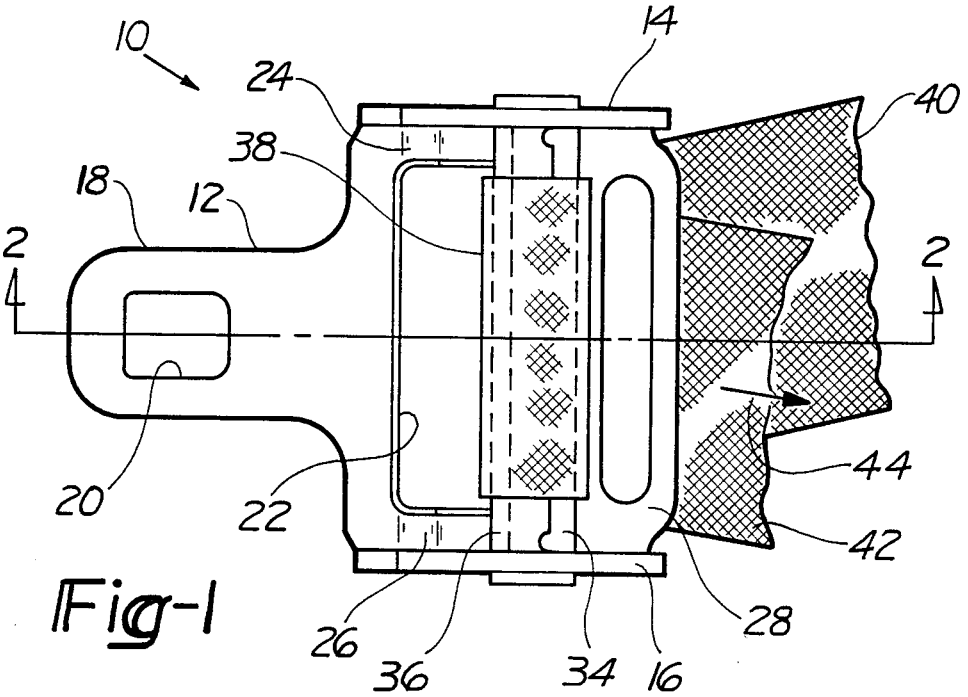
FIG. 1 is a top view of the low friction self-locking adjust tongue.
Figure 2:
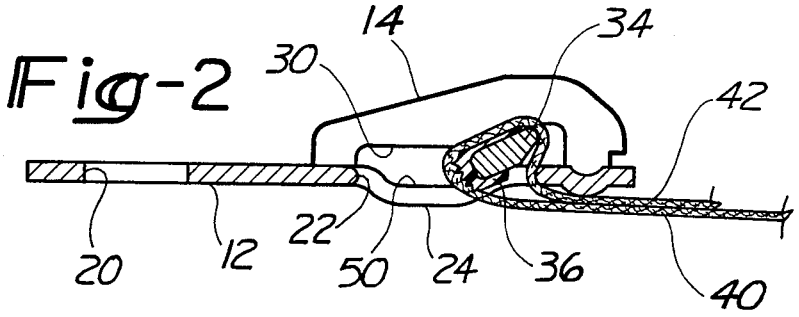
FIG. 2 is a first cross-sectional side view of the low friction self-locking adjust tongue in the locked position.
Figure 3:
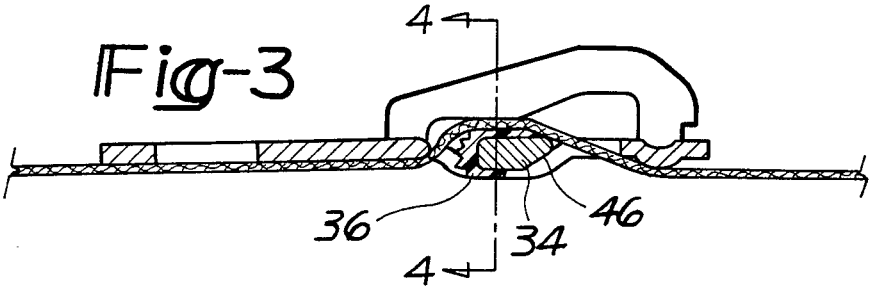
FIG. 3 is a second cross-sectional side view of the low friction self-locking adjust tongue in the released position.

The self-locking adjust tongue having a low friction between the adjust tongue and the seat belt webbing in the released or unlocked state is shown in FIGS. 1–3. Referring first to FIGS. 1 through 3, the self-locking adjust tongue 10 has a generally planar tongue plate 12 having a pair of upstanding longitudinal or length wise flanges 14 and 16 extending along a portion of the tongue plates length. At the forward end of the tongue plate, there is provided a tongue portion 18 having a latch aperture 20. A second, generally rectangular web aperture 22 is provided in the tongue plate 12 between the flanges 14 and 16. A pair of guide lands 24 and 26 are provided in the tongue plate 12 on opposite sides of the web aperture 22 adjacent to the flanges 14 and 16 which connect tongue portion 18 with the transverse cross member 28. As shown more clearly in FIGS. 2 and 3, the guide lands 24 and 26 are depressed from the plane of the tongue plate 12 and form a lock bar well 50 intermediate the extremities of the web aperature 22. The guide lands 24 and 26 form in conjunction with cutouts 30 provided in each of the flanges 14 and 16, a bi-level lock bar slot 32 which slopes upwardly and away from the bottom of the well 50 formed by the guide lands 24 and 26.

A lock bar 34 having its opposite ends received in the lock bar slots 32 spans the web aperture 22 in a direction transverse to the length of the tongue plate. The lock bar 34 is partially enclosed in a plastic sleeve 36 which entraps the lock bar 34 in the lock bar slot 32 as shall be explained with reference to FIG. 6. A length of seat belt webbing 38 having a lap portion 40 and a shoulder portion 42 is entrained through the web aperture 22, over the lock bar 34 and its plastic sleeve 36, then back out through the web aperture 22 as shown in FIGS. 1 and 2.

The operation of the self-locking adjust tongue will now be explained with reference to FIGS. 2 and 3. When the adjust tongue is inserted into a buckle (not shown) a pawl engages the latch aperture 20, locking the adjust tongue 10 in the buckle. The lap portion 40 and seat portion 42 of the seat belt webbing 38 will exit the web aperture in the same direction with the lap portion 40 of the seat belt webbing 38 lying across the pelvic region of the occupant and the shoulder portion 42 extending upward across the occupant's chest to the retractor or web guide mounted at shoulder height to a side pillar of the vehicle. The occupant will pull the shoulder portion 42 of the seat belt webbing in the direction of arrow 44 until the lap portion 40 of the seat belt webbing 38 is a snug fit about his or her pelvic region. The seat belt webbing will apply a force to the forward edge of lock bar 34 urging it to be displaced in the lock bar slot 32 to the position shown in FIG. 2. In this position the lock bar 34 is resting on the upward sloping portioon of lock bar slot 32 with the rear edge of the lock bar 34 adjacent to and above the transverse cross member 28 of the tongue plate. Preferably, the lock bar 34 has an inclined surface 46 adjacent to its rear edge tapering away from the transverse cross member 28 of the tongue plate 12, as shown more clearly in FIG. 3, to assure that the lock bar 34 will overlap the transverse cross member 28 in the event of a crash condition.

In the position of the lock bar 34 shown on FIG. 2, any forces on the seat belt webbing 38 which would tend to loosen the lap portion 40, would be applied to the forward edge of the lock bar 34 moving it up the sloped portion of the guide lands 24 and 26 and increasing the frictional forces between the lock bar 34 and the webbing 38 inhibiting the loosening of seat belt. This frictional force may be increased by serrating or knurling the forward edge of the plastic sleeve 36 as shown on FIGS. 2 and 3.

In the event of a crash condition, the crash forces would be applied to both the lap and shoulder portions of the seat belt webbing 38 which together would further displace the lock bar along the upwardly sloping surface of the guide lands 24 and 26 so that the rear edge of the lock bar 34 would now overlap the transverse cross member 28 of the tongue plate 28. The combined crash forces applied to the lap and shoulder portions of seat belt would also cause the lock bar 34 to be displaced to the upper level of the bi-level lock bar slot 32 and to bow or bend downwardly towards the transverse cross member 28, locking the seat belt webbing 38, therebetween.

When the adjust tongue is unlatched from the buckle, the force applied to forward edge of the lock bar 34 by the lap portion 40 of the seat belt webbing 38 is terminated allowing the lock bar 34 to move down the upward sloping portion of the guide lands 24 and 26 and come to rest in the bottom of the lock bar well 50 formed by the depressed guide land 24 and 26 of the tongue plate 12 as shown in FIG. 3. As the seat belt webbing 38 is retracted by the retractor (not shown) the lap portion 40 of the seat belt will be displaced approximately 180° from its position in FIG. 2 and will lie on the side of the lock bar 34 opposite the shoulder portion 42. In this state, with the lock bar 34 resting in the well 50 formed by the bi-level lock bar slot 32, the path of the seat belt webbing 38 over the lock bar 34 makes only two relatively small bends which offers negligible resistance to the passing of the seat belt webbing through the tongue plate and over the lock bar. The depth of the well formed by the guide lands 24 and 26 is selected such that the weight of the self-locking adjust tongue is sufficient to permit the adjust tongue to fall freely along the length of the seat belt webbing 38 when the seat belt webbing assumes a near verticle position. Therefore when the retractor starts to retract the seat belt webbing 38 the self-locking adjust tongue 10 will slide along the length of the webbing 38 away from the retractor and/or web guide and will not interfere with the full retraction of the seat belt webbing. This assures that the seat belt webbing will always be fully retracted and eliminates the problems encountered with the self-locking adjust tongues currently being used on automotive vehicles.

The structure of the tongue plate 12 is shown in greater detail on FIGS. 4 and 5. As previously described the tongue plate 12 has a tongue portion 18 which is received in the buckle of the safety restraint system. The tongue portion 18 has a latch aperture 20 which is engaged by a pawl in the buckle to lock the tongue plate 12 thereto. The body portion of the tongue plate has a web aperture 22 which is bounded on its lateral sides by a pair of depressed lock bar guide lands 24 and 26 and a pair of upstanding longitudinal flanges 14 and 16. The ends of the lock bar lands 24 and 26 are connected by a transverse cross member 28 which has a transverse depression 48 provided along its length. As is known in the art the transverse depression 48 increases the structural rigidity of the cross member 28 and reduces its deflection under the high loads such as produced under crash conditions.

Referring now to FIG. 5, the guide lands 24 and 26 depressed a distance "d" from the plane of the tongue plate 12 to form a well 50 intermediate the extremities of the web aperture 22. In practice, the depth "d" of the well 50 formed by the guide lands 24 and 26 is greater than $\frac{1}{2}$ the thickness of the lock bar but less than the thickness of the guide bar. In the preferred embodiment the distance "d" is nominally 2.85 millimeter and the thickness of the lock bar 34 at its ends is 3.0 millimeters. The lands 24 and 26 also have an inclined section 52 which is at an angle—to the plane of the lock plate 12. In preferred embodiment the angle—is approximately 25°.

Each of the flanges 14 and 16 has a cutout 30 which in combination with guide lands 24 and 26 define the lock bar slot 32 which captivate the ends of the lock bar 34 and guides its path of motion. The flanges 14 and 16 may also include notches 54 for attaching a cover (not shown) to the tongue plate for esthetic or decorative purposes as is known in the art.

The details of the lock bar 34 and plastic sleeve 36 are shown in FIG. 6 which is cross-sectional view taken along the cross-section line 6—6 shown in FIG. 3. The lock bar 34 has thick central section 54 having the general transverse contours shown in FIGS. 2 and 3. The opposite ends 56 and 58 of the lock bar 34 are necked down to have a narrower cross-section as shown.

The plastic sleeve 36 has an upper portion 60 which extends across the entire length of the lock bar 34 and terminates at opposite ends in verticle flanges 62 and 64. The internal surfaces of the verticle flanges 62 and 64 abut the ends of the lock bar 34 inhibiting its latteral displacement within the plastic sleeve 36. The verticle flanges 62 and 64 also slidably engage the outboard surfaces of upstanding flanges 14 and 16 and inhibit the latteral displacement of the plastic sleeve 36 with respect to the tongue plate 12.

A lower portion 66 of the plastic sleeve 36 extends along the length of the central section 54 of the lock bar 34 as shown. The two tapered ends 56 and 58 of the lock bar 34 are substantially circumscribed by the plastic sleeve 38 forming along the lower surface of the lock bar a pair of bearing pads 68 and 70 which slidably engage the guide lands 24 and 26 of the tongue plate. The forward edge of the plastic sleeve connects the upper and lower portions of the plastic sleeve 38 as shown in FIGS. 2 and 3 and as previously indicated this forward edge of the plastic sleeve 36 may be serrated or knurled to increase the friction between it and the seat belt webbing when the lap portion of the seat belt is snug up against the pelvic region of the occupant as shown in FIG. 2.

I claim:

1. In a safety restraint system having a length of seat belt webbing connected between an anchor point and a seat belt buckle, a self-locking adjust tongue adapted to connect the length of seat belt to the buckle comprising:

a generally planar tongue plate having at its forward end a tongue portion adapted to be received and locked in the buckle, a centrally disposed web aperture for receiving a loop of the seat belt webbing therethrough, a pair of depressed guide lands provided on the opposite sides of said web aperture forming a lock bar well intermediate the extremities of said web aperture and a pair of upstanding flanges each having a cutout adjacent to said guide lands, said cutouts in conjunction with said guide lands forming a bi-level lock bar slot extending rearwardly from said lock bar well to a higher level; and a transverse lock bar having its ends guided in said lock bar slot and passing through the loop of seat belt webbing received through said web aperture.

2. The adjust tongue of claim 1 wherein said guide lands have sloping surfaces extending rearwardly and upwardly from said well to the plane of said tongue plate.

3. The adjust tongue of claim 2 wherein said sloping surface is disposed at an angle of approximately 25° from the plane of said tongue plate.

4. The adjust tongue of claim 2 wherein the depth of said well is greater than ½ the thickness of said lock bar.

5. The adjust tongue of claim 1 wherein the central portion of said lock bar between said guide lands has a thicker cross-section than the end portions guided in said lock bar slot.

6. The adjust tongue of claim 5 wherein said lock bar has a forward edge facing the tongue portion of said tongue plate and a rear edge opposite said forward edge, said central portion having a tapered surface provided along its lower surface adjacent to said rearward edge sloping towards its upper surface.

7. The adjust tongue of claim 6 having a plastic sleeve enclosing at least a portion of the upper and lower surfaces of said central portion and said forward edge of said lock bar.

8. The tongue plate of claim 7 wherein said plastic sleeve encloses at least the upper and lower surfaces of the end portions of said lock bar which are guided in said lock bar slot.

9. The adjust tongue of claim 8 wherein said plastic sleeve captivates the ends of said lock bar and includes a pair of verticle flanges which slidably engage said upstanding flanges to prevent lateral displacement of said plastic sleeve and lock bar with respect to said tongue plate.

10. The adjust tongue of claim 9 wherein a serrated or knurled surface is provided on the external surface of plastic sleeve enclosing the forward edge of the lock bar.

11. A low friction self-locking adjust tongue received in the buckle of a safety restraint system, the self-locking tongue of the type having a generally planar tongue plate with a pair of upstanding flanges, and a lock bar slidably received in a pair of lock bar slots provided in the upstanding flanges, the lock bar spanning a web aperture and passing through a loop of seat belt webbing received through the web aperture, the low friction self-locking adjust tongue characterized by a pair of depressed lock bar guide lands provided in said tongue plate either side of the web aperture forming a lock bar well intermediate the longitudinal extremities of the web aperture, and wherein said pair of upstanding flanges each has a cutout adjacent to and cooperating with said guide lands to form a bi-level lock bar slot for guiding the lock bar from a released position in said lock bar well to a locking position above the plane of said tongue plate in response to the displacement of said lock bar from said lock bar well.

12. The adjust tongue of claim 11 wherein said lock bar well is depressed from the plane of said tongue plate a distance greater than ½ the thickness of said lock bar.

13. The adjust tongue of claim 12 wherein the rearmost sloping sides of said guide lands are at an angle of approximately 25° with respect to the plane of said tongue plate.

14. The adjust tongue of claim 12 wherein the central portion of said lock bar between said guide lands is thicker than the end portions.

15. The adjust tongue of claim 13 wherein said central portion extends below said end portions.

16. The adjust tongue of claim 14 wherein said lock bar has a forward edge facing said tongue and a rear edge opposed said forward edge, the lower surface of said central portion of said lock bar, adjacent to said rear end, is tapered towards the upper surface.

17. The adjust tongue of claim 16 having a plastic sleeve enclosing at least a portion of the upper and lower surfaces of said central portion and said forward edge of said adjust bar.

18. The adjust tongue of claim 17 wherein said plastic sleeve covers at least the lower surfaces of the end portions of said lock bar which engage said guide lands.

19. The adjust tongue of claim 18 wherein said plastic sleeve captivates the ends of said lock bar and includes a pair of verticle flanges slidably engaging said upright flanges to prohibit the latteral displacement of said plastic sleeve with respect to said tongue plate.

20. The adjust tongue of claim 19 wherein a serrated or knurled surface is provided on the external surface of the plastic sleeve enclosing the forward edge of the lock bar to enhance the friction between the plastic sleeves and the loop of seat belt webbing when the tongue is locked in the buckle.

21. A low friction, self-locking adjust tongue received in the buckle of a safety restraint system, the self-locking adjust tongue of the type comprising a generally planar tongue plate having a pair of upstanding flanges, and a lock bar slidably received in a pair of lock bar slots provided in the flanges, the lock bar traversely spanning a web aperture provided in the tongue plate and passing through a loop of seat belt webbing received through the web aperture, the low friction, self-locking adjust tongue characterized by bi-level lock bar slots provided in the upstanding flanges of said tongue plate adjacent to the transverse sides of the web aperture, said bi-level lock bar slot having a first portion intermediate the longitudinal extremities of the web aperture below the plane of said tongue plate, a second portion adjacent to the rear edge of the web aperture above the plane of said tongue plate, and an intermediate sloping portion connecting said first portion with said second portion.

22. The adjust tongue of claim 21 wherein said tongue plate has a pair of depressed land one on each side of said web aperture forming the lower surface of said bi-level lock bar slot and wherein cutouts are provided in the upstanding flanges to form the upper surfaces of said bi-level lock bar slot.

* * * * *